US006333070B1

(12) United States Patent
Ferro

(10) Patent No.: US 6,333,070 B1
(45) Date of Patent: Dec. 25, 2001

(54) METHOD FOR REPRODUCING ON A FLEXIBLE FILM REFLECTION IMAGES WHICH CAN BE HOT-TRANSFERRED TO A PLURALITY OF DIFFERENT MATERIALS

(75) Inventor: Mario Ferro, Padua (IT)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/469,502

(22) Filed: Dec. 22, 1999

(30) Foreign Application Priority Data

Dec. 23, 1998 (IT) ..... MI98A2820

(51) Int. Cl.[7] ..... B41M 3/12; B05D 5/06

(52) U.S. Cl. ..... 427/148; 427/146; 427/147; 427/150; 427/151; 427/152; 427/163.4; 427/189; 427/191

(58) Field of Search ..... 427/146, 147, 427/148, 150, 151, 152, 163.4, 189, 191, 261

(56) References Cited

U.S. PATENT DOCUMENTS 3,172,942 * 3/1965 Berg .
4,075,049 * 2/1978 Wood ..... 156/220
4,359,491 * 11/1982 Lai-Chun ..... 427/148
5,763,000 * 6/1998 Hedblom ..... 427/136
6,159,537 * 12/2000 Crandall ..... 427/163.4

* cited by examiner

*Primary Examiner*—Shrive P. Beck
*Assistant Examiner*—Jennifer Kolb
(74) *Attorney, Agent, or Firm*—Lowe Hauptman Gilman & Berner, LLP

(57) ABSTRACT

The invention relates to a method for producing on a flexible film reflecting images which can be hot-transferred to a plurality of different materials, the method comprising a first processing step in which a polyester film is processed by a thermoplastic resin in a aromatic solution, a second processing step in which on the film are deposited a plurality of glass beads, in an adjoining relationship, a resin priming processing step for allowing the glass beads to be properly retained in place, a processing step of using a vinylchloride-vinylacetate-aromatic solvent solution with an addition of a metal powder having high mirror-like properties in order to allow the glass beads to refract the light, and a color printing step for printing any desired colors on desired regions, as well as a further leveling processing step for the images, and a final processing step of using a thermo-transfering solution in order to allow the printed images to be transferred under temperature and pressure.

11 Claims, No Drawings

METHOD FOR REPRODUCING ON A FLEXIBLE FILM REFLECTION IMAGES WHICH CAN BE HOT-TRANSFERRED TO A PLURALITY OF DIFFERENT MATERIALS

BACKGROUND OF THE INVENTION

The present invention relates to a method for producing on a flexible film reflecting images which can be hot-transferred to a plurality of different materials.

More specifically, the invention provides a method for producing on flexible films a plurality of different images, in particular reflecting images, which images can be hot-transferred to several different materials such as: polypropylene, acrylonitrile butadiene styrene (PP-ABS), polyethylene (PEA), polyurethane (PU), polystyrene (PS), and polyamide 6 (PA6, also known as Nylon 6), rubber, synthetic and natural fabrics, leather and metal materials and the like.

SUMMARY OF THE INVENTION

Thus, the aim of the present invention is to provide a method for producing on flexible films reflecting images, which images can be hot transferred onto a of different material, in particular, though not exclusively, on plastics materials.

Within the scope of the above aim, a main object of the present invention is to provide such a method specifically designed for making said reflecting images in a very simple and inexpensive manner.

Yet another object of the present invention is to provide such a reflecting image making method which is very reliable and safe in operation.

According to one aspect of the present invention, the above mentioned aim and objects, as well as yet other objects, which will become more, apparent hereinafter, are achieved by a method for producing on a flexible film reflecting images, which can be hot-transferred onto a different material, said method being characterized by the feature of the main claim.

More specifically the invention provides a method for reproducing on a flexible film reflecting images, which can be hot transferred to a different material, said method comprising a first processing step in which a polyester film is processed by an aromatic solution of a thermoplastic resin, a second processing step in which on said film a plurality of glass beads, in an adjoining relationship are deposited, a resin priming processing step for allowing said glass beads to be retained in place, a vinylchloride-vinylacetate resin solution in an aromatic solvent containing a metal powder having high mirror-like properties is applied to allow said beads to refract light, and a printing step in which desired regions are printed in colors for providing a desired image, as well as a further leveling step causing the printed product to have a desired thickness, and a finishing processing step of using a thermotransferring solution in order to provide the printed image with the capability of being thermally transferred under pressure onto said materials.

According to a preferred embodiment of the present invention, the first polyester film processing step is carried out with a thermoplastic resin including a styrene-isoprene copolymer having a styrene contents of 15%, which is spread at 34 msh and contemporaneously stabilized at 50° C. by hot air.

According to another preferred embodiment of the present invention, the glass beads are deposited at 77 msh and have a reflecting index of 1.9 with a diameter from 40 to 60 microns.

The priming processing step is carried out by using a vinylchloride-vinylacetate resin in an aromatic solution with a deposition at 150 msh and with a thermosealing at 50° C. in forced hot air.

Further details, advantages and other important features of the present invention will become more apparent hereinafter from the following detailed disclosure of a preferred embodiment of the inventive method, which is given by way of a not limitative example of several possible variations of the invention.

More specifically, the invention relates to a method for producing on a flexible film reflecting images, which are adapted to be hot transferred to several other materials such: PP-ABS, PEA, PU, PS PA6, rubber, synthetic and natural fabrics, leather and metal materials.

The subject method comprises the step of depositing a plurality of crystals, having a well defined pattern, which crystals are adapted to be transferred, by heat and pressure, onto one of the above mentioned materials.

At first, a 35/50 micron thickness polyester film is processed by a copolymeric styrene-isoprene thermoplastic resin having a styrene contents of 15%, by an aromatic solution of said resin and spreading it at 34 msh and simultaneously stabilizing it at 50° C. by using hot air.

Then, a plurality of glass beads are deposited at 77 msh, said glass beads having a refracting or reflecting index of 1.9 and a diameter from 40 to 60 microns, the glass beads being arranged in a mutual adjoining relationship.

Then, processing by polymerizing using a vinylchoride-vinylacetate resin in an aromatic solution with a deposition at 150 msh will allow the glass beads to be retained in place in order to avoid displacement during the following processing steps.

During this step, thermosealing at 50° C. in forced hot air is carried out.

Then, a vinylchoride-vinylacetate solution in an aromatic solvent is applied to the material by adding aluminium powder having high mirror-like properties to provide the desired light reflecting capabilities.

Then, desired regions of the thus obtained material will be printed upon by using a vinylchrolide-vinylacetate compound, at 77 msh, for providing a desired image which will be thermoset at 50° C. in hot air.

Then, the provided image will become level at a desired thickness, by using a solution resin of the above mentioned type, with either one or two passes at 27 msh.

Then, the obtained material will be subjected to finishing processing by using a thermotransferring solution based on vinylacetatevinylchloride at 77 msh, whereby the printed image can be transferred under temperature and pressure on the above mentioned plastics material.

From the above disclosure it should be apparent that the invention fully achieves the intended aim and objects.

What is claimed is:

1. A method for producing on a flexible film reflecting images that can be hot transferred to a different material, said method comprising:

processing a polyester film with an aromatic solution of a thermoplastic resin;

depositing on said film a plurality of glass beads in an adjoining relationship;

applying a primer to said glass beads in an amount and under conditions sufficient to retain said glass beads in place;

applying to the primed beads a vinylchloride-vinylacetate resin solution in an aromatic solvent containing a metal powder having high mirror-like properties to allow said beads to refract light;

printing desired regions of the metal powder-containing solution in colors thereby forming a desired image as a printed product;

leveling said printed product to a desired thickness; and then applying a thermotransferring solution onto said printed product thereby providing the printed image with the capability of being thermally transferred under pressure onto a different material.

2. The method according to claim 1, wherein said theromoplastic resin is a styrene-isoprene copolymeric thermoplastic resin.

3. The method according to claim 2, wherein said copolymeric styrene-isoprene thermoplastic resin is spread at 34 msh while stablizing it at 50° C. by hot air.

4. The method according to claim 1, wherein said glass beads are deposited at 77 msh and have a refracting index of 1.9 and a glass bead diameter from 40 to 60 microns.

5. The method according to claim 1, wherein the primer applied to said beads is an aromatic solution of a vinylchloride-vinylacetate resin and it is applied with a deposition of 11.4 grams/$m^2$.

6. The method according to claim 5, wherein the primer is thermosealed at 50° C. under forced hot air.

7. The method according to claim 1, wherein said metal powder is an aluminum powder.

8. The method according to claim 1, wherein desired regions of said film are printed using a vinylchloride-vinylacetate solution with a deposition of 28 grams/$m^2$.

9. The method according to claim 8, further comprising, subsequent to the printing step, thermosetting said printed product at 50° C. under forced air.

10. The method according to claim 1, wherein said leveling said printed product is performed by using a vinylchloride-vinylacetate resin solution either with a single or a double passage with a coverage corresponding to 94 grams/m2.

11. The method according to claim 1, wherein said thermotransferring solution is based on vinylacetate-vinylchloride and has a coverage capability of 28 grams/$m^2$.

* * * * *